US005498314A

United States Patent [19]

Kinsley, Jr.

[11] Patent Number: 5,498,314

[45] Date of Patent: Mar. 12, 1996

[54] PROCESS FOR MAKING A PAPER BASED PRODUCT CONTAINING A BINDER

[75] Inventor: Homan B. Kinsley, Jr., Powhatan, Va.

[73] Assignee: CPG Holdings Inc., Richmond, Va.

[21] Appl. No.: 103,134

[22] Filed: Aug. 9, 1993

Related U.S. Application Data

[63] Continuation-in-part of Ser. No. 833,165, Feb. 10, 1992, Pat. No. 5,328,567.

[51] Int. Cl.[6] ..... D21H 17/10

[52] U.S. Cl. ..... 162/158; 162/146; 162/157.2; 162/164.1; 162/164.3; 162/165; 162/168.1; 162/206; 162/207

[58] Field of Search ..... 162/168.1, 146, 162/158, 179, 164.1, 164.3, 165, 206, 157.2, 207

[56] References Cited

U.S. PATENT DOCUMENTS

| | | | |
|---|---|---|---|
| 2,402,469 | 6/1946 | Toland et al. | 162/168.1 |
| 3,184,373 | 5/1965 | Arledter | 162/169 |
| 3,509,083 | 4/1970 | Winebrenner et al. | 260/23.7 |
| 3,630,831 | 12/1971 | Jongetjes | 162/156 |
| 3,937,648 | 2/1976 | Huebner et al. | 162/169 |
| 3,937,865 | 2/1976 | Jongetjes | 162/168.1 |
| 4,372,814 | 2/1983 | Johnstone et al. | 162/124 |
| 4,426,470 | 1/1984 | Wessling et al. | 162/168.1 |
| 4,481,075 | 11/1984 | Dailly et al. | 162/168.1 |
| 4,545,854 | 10/1985 | Gomez et al. | 162/135 |
| 4,769,109 | 9/1988 | Tellvik et al. | 162/168.1 |
| 4,810,329 | 3/1989 | Camisa | 162/168.1 |
| 4,865,691 | 9/1989 | White | 162/168.1 |
| 5,034,097 | 7/1991 | Martinez et al. | 162/164.3 |
| 5,091,055 | 2/1992 | Frednucci et al. | 162/168.1 |
| 5,328,567 | 7/1994 | Kinsley, Jr. | 162/158 |

*Primary Examiner*—Peter Chin

*Attorney, Agent, or Firm*—Burns, Doane, Swecker and Mathis

[57] ABSTRACT

Provided is a process for making a paper based product which comprises first preparing a slurry of a cellulosic pulp, a particulate binder, and an emulsion comprised of lecithin and a fatty acid or derivative thereof. This slurry is then drained of liquid to form a web, with the web being dried to provide the paper based product. The preferred polymeric binder is a hydrolyzed polyvinyl alcohol powder, which binder can be present in the final dried product in amounts of up to about 20 weight percent or more. The use of the emulsion comprised of lecithin and a fatty acid or derivative thereof permits a web containing such a high amount of sticky polymeric binder to be dried at high temperatures, without the web sticking to the drying cans generally used in commercial processes. The process of the present invention thereby permits one to efficiently prepare such a paper based product using conventional, commercial papermaking machinery.

33 Claims, 1 Drawing Sheet

PROCESS FOR MAKING A PAPER BASED PRODUCT CONTAINING A BINDER

CROSS-REFERENCE TO RELATED APPLICATIONS

The subject application is a continuation-in-part of U.S. Ser. No. 07/833,165, filed Feb. 10, 1992 now U.S. Pat. No. 5,328,567.

BACKGROUND OF THE INVENTION

The present invention relates to a method for making a paper based product which contains a polymeric binder. More specifically, the present invention relates to the use of an emulsion in the manufacture of paper based products containing a polymeric binder. The present invention also relates to the manufactured paper products, which products exhibit excellent tensile, peel and Z-directional strength.

The papermaking industry as well as other industries have long sought methods for enhancing the strength of products formed from fibrous materials such as, for example, paper and board products formed of cellulose fiber or pulp as a constituent. The problems and limitations presented by inadequate dry strength have been particularly acute in the numerous industries where recycled furnish or fiber mechanically derived from wood is utilized in whole or part. In the papermaking industry for example, recycled cellulose fiber is typically used in the manufacture of newsprint and lightweight coated papers. These recycled fibers, however, are of a generally shorter length than chemically-pulped fibers which in turn provides paper having relatively poor dry-strength properties in comparison to paper manufactured from virgin, chemically pulped fiber. The use of virgin chemically pulped fiber for all paper and board production, however, is extremely wasteful in terms of natural resource utilization as well as cost prohibitive in most instances and applications.

Various methods have been suggested in the past for improving the dry-strength and related properties of a sheet formed from fibrous materials such as paper or board materials formed of cellulose fiber. One alternative for improving the dry-strength properties of paper products, for example, involves the surface sizing of the sheet at a size press after its formation. While some of the critical properties of the product may be improved through sizing the surface of the sheet, many papermaking machines, for example, including board and newsprint machines, are not equipped with a size press. Moreover, only the properties of the surface of the sheet are appreciably improved through surface sizing. Surface sizing therefore is either not available to a large segment of the industry or is inadequate for purposes of improving the strength of the product throughout the sheet. The latter factor is especially significant since paper failures during printing, for example, are obviously disruptive to production and extremely costly.

A preferred alternative to surface sizing of a sheet is to increase the strength of the product through the addition of chemical additives directly to the fiber furnish prior to forming the sheet. Common additives at the wet-end of a paper machine, for example, include cationic starch or melamine resins. The problem presented by known wet-end additives used in the papermaking industry, however, is their inability to dramatically improve the mechanical properties of the paper in the Z-direction, such as peel strength, surface pick resistance and Scott internal bond. Another problem presented by known wet-end additives is relatively low degree of retention on the cellulose fiber during the initial formation of the sheet at the wet-end of the paper machine. In most applications, significant portions of the wet-end additives accompany the white water fraction as it drains through the wire due to high dilution and the extreme hydrodynamic forces created at the slice of a fourdrinier machine. Alternatively, a significant portion of the additive may be lost in solution during the dwell time between its addition to the stock and the subsequent formation of the sheet on the machine at prevailing operating temperatures. Accordingly, the potential benefits achievable through the use of known methods for internally strengthening fiber products have seldom been realized in practice. Indeed, when the cost of the chemical additives is additionally considered, any marginal benefits actually achieved have been largely disappointing.

A previously known and particularly desirable surface sizing agent applied in the paper industry is polyvinyl alcohol. The use of polyvinyl alcohol as a surface sizing agent or adhesive is described for example, in U.S. Pat. Nos. 2,330,314 to Schwartz; 3,183,137 to Harmon et al; 3,276,359 to Worthen et al; and 3,878,038 to Opderbeck et al. Other patents have additionally described the use of polyvinyl alcohol as a surface sizing agent following the use of different compositions as wet-end additives, such as melamine formaldehyde resin, as described, for example, in U.S. Pat. No. 3,773,513 to MacClaren. In addition, U.S. Pat. No. 4,372,814 to Johnstone et al, describes the use of fully hydrolyzed polyvinyl alcohol as a "binder" for a distinct group of wet-end additives and again, thereafter, as a surface sizing agent.

U.S. Pat. No. 2,402,469, Toland et al, describes the use of polyvinyl alcohol as a wet-end additive to improve the wet-strength as opposed to dry-strength properties of the sheet. The addition level proposed in the Toland patent, however, is approximately ten percent on an oven-dried weight basis of the pulp, apparently reflecting extremely low-retention at the wet-end even at the relatively low paper machine operating speeds which prevailed at that time. In addition, the polyvinyl alcohol product described in Toland et al is soluble in water at 130°F. Since many paper machine chests are maintained at prevailing temperatures of 130° F., or higher, the process described in the Toland et al patent would therefore be ineffectual in most, if not all, papermaking applications.

In a 1973 publication by John Wiley and Sons on the subject of polyvinyl alcohol, Chapter 12 is devoted to discussions of the use of this product in paper manufacturing. Among other subjects, the subject of "internally sizing" paper with polyvinyl alcohol is addressed and references the above-noted Toland et al patent and additionally Japanese Patent No. 12,608 relating to layered board and assigned to Nippon Gohsei of Osaka, Japan. The publication describes the desirable properties of a polyvinyl alcohol product which purportedly can be used as a wet-end additive and identifies a particular grade sold by Nippon Gohsei, "Gohsenol P-250," as suitable for direct addition to beater size. The Gohsenol P-250 product is described in the publication as 98–99 mole percent hydrolyzed and as having a dissolving temperature of 67°–70° C.

In a 1982 technical paper presented during the 982 TAPPI Papermakers Conference, Dr. David Zunker of E.I.duPont deNemours & Company, Inc. describes the significant problem in achieving any retention of polyvinyl alcohol at a wet-end of a paper machine. In that paper, the use of mixtures of polyvinyl alcohol and cationic trimethylolmelamine as a binder is proposed as a solution to the retention problem. The use of "TMM" as proposed by Dr. Zunker, or alternatively the use of cationic starch as a retention aid for polyvinyl alcohol has not been successful, however, because the negatively-charged anionic white water quickly neutralizes the positive cationic charges of the starch or TMM after the paper machine reaches equilibrium in its white water system. In addition, TMM is a known enhancer of wet-strength properties which presents distinct problems in repulping any fully dried broke for reuse as furnish.

Nevertheless, the use of polyvinyl alcohol as a binder for use in making paper products and other webs has increased in recent years. For example, U.S. Pat. No. 3,937,865 discloses the use of polyvinyl alcohol as a binder for non-woven glass fiber webs. The polyvinyl alcohol used is a powder or suspension. The glass fiber webs bonded with the polyvinyl alcohol are generally impregnated with a solution of epoxy resin, arranged as a laminate, and compressed at elevated pressure and temperature to form the final laminate.

U.S. Pat. No. 4,865,691 discloses the use of a particular grade of polyvinyl alcohol which is super-hydrolyzed and which is substantially insoluble in water maintained at 130° F. as a "wet-end additive" to internally strengthen paper based products. The particular polyvinyl alcohol used has been introduced only recently for use in surface sizing. The product is processed from material imported from China. Unlike its domestic counterparts, the grade of polyvinyl alcohol used in U.S. Pat. No. 4,865,691 is a fully hydrated wet-end additive having a characteristic branched appearance and a consistency much like that of cellulose fiber. The particles have a wood fiber-like appearance as contrasted with commercial domestic grades having a uniform, generally "crystalline" and spherical appearance under magnification. In the manufacture of the polyvinyl alcohol product a single screw saponifier or hydrolyzer is utilized rather than the prevailing contemporary belt or tank reactors which are in use in the United States. The screw saponifier draws the polyvinyl alcohol during saponification. As a result, wood fiber-like particles are produced having a relatively low dry bulk density which swell extensively when fully hydrated. The addition of the polyvinyl alcohol at the wet-end is exemplified in the examples of U.S. Pat. No. 4,865,691 to generally be in an amount ranging from about 0.25 to about 1 percent on an oven-dried weight basis for the pulp.

While the use of a polymeric binder such as polyvinyl alcohol can be possible in small amounts, the use of larger amounts such as 10 weight percent up to 20 weight percent or more provides a very difficult problem. Even if the polymeric binder is not water soluble and therefore becomes incorporated in the paper web, during drying of the web the polymeric binder can become very sticky and stick to the felts and drying cans employed in commercial operations. As a result, the entire operation must be shut down due to the sticking problem. The potential benefits of using larger percentages of a polymeric binder in a paper based product are therefore lost as such products simply cannot be made from a practical point of view.

Accordingly, an object of the present invention is to provide a process for efficiently making a paper based product which contains a polymeric binder.

Another objective of the present invention is to prepare such a paper based product using commercial papermaking equipment where the product can comprise 10 weight percent up to 20 weight percent and more of the polymeric binder.

Still another object of the present invention is to provide a novel paper based product having enhanced tensile, stiffness, high temperature strength, peel and Z-directional strength.

Yet another object of the present invention is to provide a novel paper based product having an amount of polyvinyl alcohol or other binder which has heretofore been unavailable to the prior art.

These and other objects of the present invention will become apparent upon a review of the following specification, the Figure of the Drawing, and the claims appended thereto.

SUMMARY OF THE INVENTION

In accordance with the foregoing objectives, the present invention provides a process for making a paper based product which comprises first preparing a slurry of a cellulosic pulp, a particulate polymeric binder substantially insoluble in water, and an emulsion comprised of lecithin and a fatty acid or derivative thereof. This slurry is then drained of liquid to form a web, with the web being dried to provide the paper based product. The preferred polymeric binder is a hydrolyzed polyvinyl alcohol powder, which binder can be present in the final dried product in amounts of up to about 20 weight percent or more.

The key to the process is the use of an emulsion comprised of lecithin and a fatty acid or derivative thereof, which emulsion permits a web containing a high amount of sticky polymeric binder, which is sticky at the drying temperature employed, to be dried at high temperatures without sticking to the drying cans generally used. The process of the present invention thereby permits one to efficiently prepare such a paper based product using conventional, commercial papermaking machinery.

The paper based product prepared by the process of the present invention is also a novel product in that it exhibits heretofore unknown tensile, peel and Z-directional strength for a paper based product. Such advantageous physical properties are achieved due to the high percentage of binder which can be incorporated into the product using the process of the present invention.

DETAILED DESCRIPTION OF THE PREFERRED EMBODIMENTS

Figure 1:
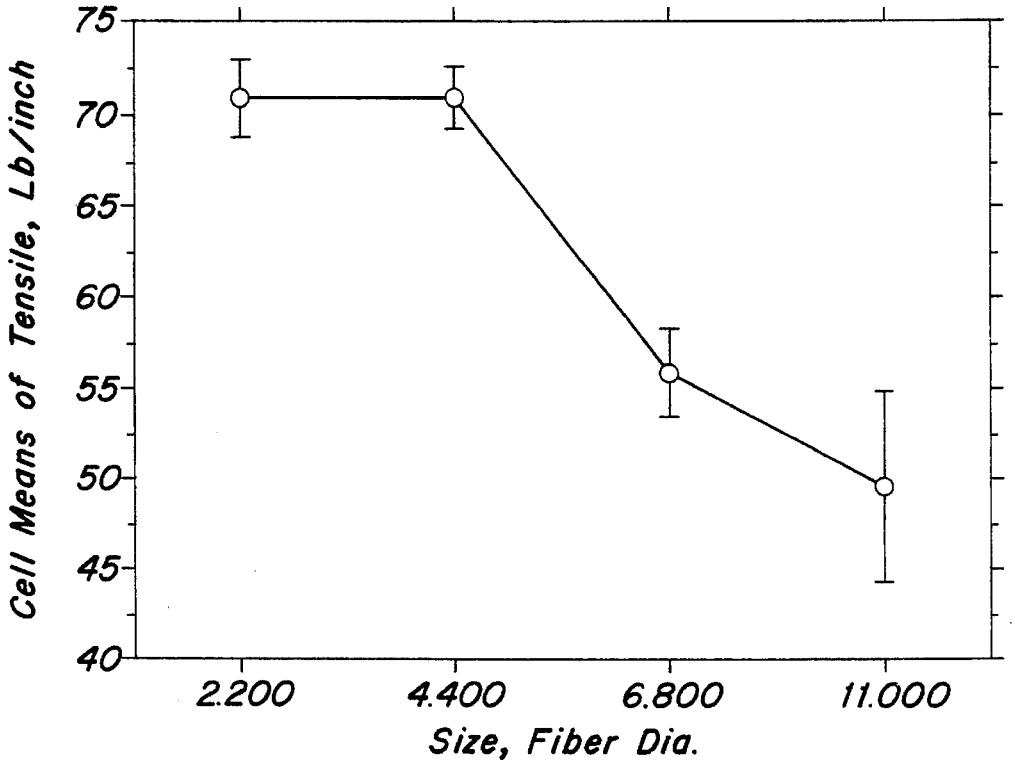
FIG. 1 is a plot of particle size versus average tensile relating to handsheets prepared containing a particulate binder.

The process of the present invention permits one to efficiently make a paper based product using conventional technology and machinery, despite the fact that the product contains a substantial amount of polymeric binder to improve the strength of the final product. By employing the process of the present invention, the problem of the binder becoming sticky at the temperature of drying and sticking to the drying cans used in conventional papermaking processes is overcome. The paper based product can therefore be prepared quickly and cost effectively using conventional machinery.

The process of the present invention comprises preparing a slurry of a cellulosic pulp, which can be any pulp, e.g., wood pulp, known for making paper based products. Examples of suitable pulps are northern softwood kraft pulp, southern pine pulp, northern and southern hardwood kraft pulps, and mechanical pulps such as groundwood, CTMP pulp and TMP pulp. Synthetic fibers may also be present in addition to the cellulosic pulp, such synthetic fibers being comprised of any typical synthetic fiber which has been known to be employed in paper based products. Such fibers include nylon, rayon, acrylic, acetate, aramid and polyester fibers. The most preferred synthetic fibers are polyester fibers.

The cellulosic pulp comprises generally from 60 to 90 weight percent of the slurry solids. When synthetic fibers are also present in the slurry, the synthetic fibers can generally comprise from 5 to about 20 weight percent of the slurry solids.

Along with the fiber pulp, the slurry also contains a particulate binder, preferably polymeric, which is substantially insoluble in water. For the purposes of the present invention, the phrase "substantially insoluble in water" in reference to the polymeric binder refers to a particulate material which will not appreciably dissolve in the aqueous slurry, i.e., no more than 25% by weight would dissolve over a 30 minute period. Preferably, the solubility of the binder is such that no more than 15% by weight would dissolve over a 30 minute period, and most preferably no more than 10% by weight would dissolve in the aqueous slurry over a 30 minute period.

The binder is particulate in nature, such as a powder, and can be added as a dry solid or in a slurry. The binder can be a polyvinyl alcohol powder, an acrylic powder, a phenolic powder, an epoxy powder, or any other water insoluble adhesive powder, which is preferably a polymeric powder. The most preferred binder is a polyvinyl alcohol powder.

For a polyvinyl alcohol powder to be substantially water insoluble, the polyvinyl alcohol must be hydrolyzed, for example, at least 98%. It has been found that the use of such a hydrolyzed polyvinyl alcohol polymer permits the successful use of the polymer while avoiding dissolution of the polyvinyl alcohol in the water used to slurry the fibers. Rather, the hydrolyzed polyvinyl alcohol swells in the water, but does not dissolve. Examples of preferred polyvinyl alcohol polymers which are commercially available in powder form and which function in accordance with the present invention as a suitable binder are those sold by Air Products and Chemicals, Inc. of Allentown, Pa. as Airvol polyvinyl alcohol powder grades 125SF (99.3%+hydrolyzed), 165SF (99.3%+hydrolyzed), 350SF (98–98.8% hydrolyzed), 107SF (98–98.8% hydrolyzed), and 325SF (98–98.8% hydrolyzed).

The particulate nature of the polymeric binder is also important with respect to the final properties of the paper based product. It is preferred that the polymeric binder have a particle of a water swollen size (i.e., the equilibrium size of the particle in water) equivalent to a diameter of about 3 to 7 of the cellulosic fibers used in making the paper based product. It has been found that the use of such sized particles provides a paper based product having excellent peel strength as well as Z directional strength.

The slurry prepared also contains an aqueous emulsion. This aqueous emulsion is comprised of lecithin and a fatty acid or derivative thereof. The amount of lecithin employed is sufficient to create a stable aqueous emulsion with the fatty acid and/or a derivative (e.g., ester) thereof. In general, the weight ratio of lecithin to fatty acid or derivative thereof in the emulsion ranges from about 1:9 to about 3:7, with about 2:8 being preferred.

The lecithin can be lecithin derived from any plant, animal or microbial source. Suitable lecithin materials are commercially available, and include soybean lecithin and yolk lecithin. The fatty acids are preferably $C_8$–$C_{20}$ fatty acids, or the ester derivative thereof, i.e., the fatty acid ester. For reasons of practicality, the fatty acid or fatty acid derivative should be liquid at the processing temperatures of the process. The more preferred fatty acids are $C_{12}$–$C_{18}$ fatty acids or derivatives thereof, with oleic acid being the most preferred due to its availability and the excellent results observed. $C_{15}$–$C_{20}$ fatty acids or their derivatives are also preferred.

It has been found that an emulsion of the lecithin and the fatty acid compound provides an additive which gives excellent release to the web product despite the presence of the sticky polymeric binder, thereby permitting the web to be dried on drying cans and other conventional equipment. An emulsion containing this particular combination of components has also has been found to not significantly reduce the physical properties of tensile and tear strength of the final paper based product. This is an important consideration since many additives can destroy or substantially reduce the physical properties of tensile, peel and Z-directional strength of a paper based web. The components of the emulsion are also advantageously ingredients which are safe for use in any materials which are to have contact with food products.

The particulate binder should be thoroughly mixed with the cellulosic pulp in the slurry. This mixing is preferably done prior to the wet end of the paper machine. The mixing insures uniform distribution of the binder particulates in the formed paper product. Prior to mixing with the cellulosic pulp in the aqueous slurry, it is preferred that the particulate binder be fully hydrated or reach equilibrium in an aqueous suspension, generally at room temperature. This is most preferred when the particulate binder is a polyvinyl alcohol powder. If, however, addition of the particulate binder is made in dry form directly to the cellulosic slurry, it is preferably made so as to allow sufficient dwell time to permit the particles to reach equilibrium in the aqueous suspension.

The emulsion comprised of lecithin and fatty acid and/or derivative thereof can be introduced into the slurry at any time in the papermaking process prior to the drying sequence. Therefore, the emulsion can be added to the head box, directly to the pulp (slurry) or anywhere down the line. In an alternative embodiment of the present invention, the emulsion can also be sprayed directly onto the dryer cans, or the web can be sprayed with the emulsion prior to drying. The key is to have the emulsion coat the drying surfaces of the drying cylinders so that when the particulate binder is activated by the heat, sticking to the surface of the drying cylinder does not occur. It is most preferred, however, that the emulsion be placed directly into the slurry since this permits a most efficient, continuous process without any concerns about the web sticking to the surface of the drying cylinders. If the emulsion were to be sprayed onto the surface of the drying cylinders or on the web prior to entering the drying sequence of the process, such spraying would have to also be continuous or sufficiently periodic to permit the running of a continuous process. Simply creating a slurry containing the emulsion, however, is the most effective and easily accomplished means of conducting the process.

Once the slurry has been prepared, the liquid is drained from the slurry to form a web. A conventional fourdrinier or cylinder machine may be used for this purpose or any suitable dewatering form having apertures can be used. After forming the web by draining the liquid, the web maybe optionally pressed to remove additional water, before drying. It is important that during or after the drying procedure the web is heated to a temperature where the binder particles become sticky, thus allowing the binder particles to bond with the fibers of the web. When polyvinyl alcohol is used as the binder, the temperature to which the web is heated during drying is advantageously near the boiling point of water (e.g., 190°–220° F.). This makes for a very heat efficient and effective process as the polyvinyl alcohol particles are activated, or become sticky, at the very temperature needed to dry the web. When conventional papermaking machinery is used, drying cans are used to dry the continuous paper based product being manufactured.

If the particulate polymeric binder is polyvinyl alcohol, as discussed above, it swells in the water, but does not dissolve. When the web is formed by draining the liquid from the slurry, the swollen binder is filtered out by the fibers and becomes part of the paper structure. When the sheet is then heated in the dryer section, the surface of the polymeric particulate then dissolves and forms an adhesive glue which bonds the fibers together. It is this adhesive glue which causes the problems of sticking to the drying cans. The presence of the emulsion comprised of lecithin and the fatty acid or derivative thereof, however, has been found to avoid any sticking of the web. The sticking is avoided whether the polymeric binder is present in an amount of about 10 weight percent, 15 weight percent, 20 weight percent or more based on the dry weight of the web. This sticking is avoided by using small amounts of the emulsion, e.g., amounts such that the concentration of organic components (lecithin and fatty acid and/or derivative) in the water used at the headbox or cylinder vat where the web is formed ranges from about 5 to about 40 ppm, and more preferably from about 20 to about 40 ppm. If the water is hard, the multi-valent cations in the water will coagulate the emulsion release material and render it less effective. This can be compensated for by adding sufficient emulsion to react with all of the cations in the hard water. If for example, the hardness was 100 ppm, i.e., it compensated for 100 ppm of the emulsion, then 105 to 140 ppm of the emulsion should be added in order to establish the desired concentration of organic constituents in the range of from 5 to 40 ppm. In any event, the amount of emulsion used can vary and one need use enough simply to avoid the sticking problem of the web to the drying cylinders or cans.

Thus, the process of the present invention with the use of its emulsion permits one to efficiently and effectively prepare a paper based product containing as much as 20 weight percent of a polymeric binder or even more. The resulting product, because of the presence of the polymeric binder, has improved tensile, peel and Z-directional strength which combination has heretofore been unknown to the prior art. As a result of such physical properties, the process of the present invention makes it feasible to realize many advantages in the use of such polymeric binders.

For example, use of the process of the present invention permits use of polymeric binders in preparing paper based products on a continuous basis which have sufficient strength in the Z-direction to replace cloth in many applications. One example is the replacement of cloth as a backing to an abrasive paper such as sandpaper. The peel and high temperature tensile strength of the paper based product prepared by the process of the present invention is sufficiently high, due to the high amount of polymeric binder contained therein, that the product meets the physical requirements.

Use of the present process also permits one to increase a paper product's physical strength without refining. By avoiding refining, there will be less damage to fiber strength. This will improve those properties like tear and fold which can be reduced by the damage which occurs to fibers during refining. Avoiding refining also saves the energy required to conduct the refining process.

The products of the present invention can be applied wherever there is a need for very strong, durable paper based products. Additional examples include release bases, applications in packaging, building materials, reinforcement materials, and elements for automotive lube oil filters/filtration, printing paper as well as notebook covers. And most importantly, the products can be made using conventional papermaking machinery without any modification thereto.

The present invention will be illustrated in greater detail by the following specific examples. It is understood that these examples are given by way of illustration and are not meant to limit the disclosure or the claims to follow. All percentages in the examples, and elsewhere in the specification, are by weight unless otherwise specified.

In the following Examples, the tensile test was conducted in accordance with TAPPI standard method T220. The tear test referred to is also conducted in accordance with TAPPI-T220. The Z-directional measurements made were made using a procedure similar to that described with regard to TAPPI-UM584. The Scott internal bond test was performed on a commercial Scott bond tester. The peel strength was determined using a wet sheet folded in two to provide two wet sheets. The folded sheet was then pressed and dried. Sheet separation was then initiated, and each jaw of a tester was respectively attached to one of the separated ends with the force in grams needed to separate the sheet then being measured.

The general procedure followed to prepare the handsheets described in the following Examples is as follows. The prepared furnish was added to a handsheet mold and drained of water through a screen to deposit the fiber pulp on the screen. The resulting wet sheet was then pressed to remove the majority of water, and then dried on a drying cylinder. The procedure used was similar to that of TAPPI-T205 describing the formation of handsheets for physical tests of pulp.

EXAMPLE I

Three handsheets were made using furnish containing recovered newsprint pulp and northern softwood kraft pulp. A polyvinyl alcohol powder was allowed to swell in water for 1 hour at room temperature. The slurry of swollen polyvinyl alcohol powder was then heated to 55° C. and added to the furnish of two of the three handsheets. The polyvinyl alcohol powder was manufactured by Air Products and Chemicals, Inc., under the designation Airvol 165SF. To the furnish was also added 20 ppm, based upon the slurry, of an emulsion comprised of 80 parts by weight of a mixture of $C_8/C_{10}$ fatty acid methyl esters and 20 parts by weight lecithin. The emulsion was aqueous and contained 2% organic constituents.

The handsheets were formed and then dried on a drying cylinder, with the tensile strength, tear strength and Scott internal bond of each respective handsheet subsequently being measured. The basis wt. (lb/3000 sq ft) of each handsheet was about 60 and the caliper of each was about 10.2 mils. The amount of newsprint pulp, northern softwood kraft pulp and polyvinyl alcohol used for each handsheet, as well as the results of the physical tests performed on each sheet, are contained below in Table 1.

TABLE 1

| Hand-sheet | Recovered Newsprint Pulp (%) | Marathon Softwood Pulp (%) | PVOH (%) | Tensile (lb/inch) | Tear (gf) | Scott Internal Bond |
|---|---|---|---|---|---|---|
| A | 70 | 30 | 0 | 16.3 | 111 | 4.3 |
| B | 63 | 27 | 10 | 28.0 | 96 | 46.0 |
| C | 59.5 | 25.5 | 15 | 30.5 | 76 | 72.7 |

From the foregoing data, it can be seen that one is able to increase the tensile strength of the product without a substantial drop in tear strength when using the emulsion of the present invention. Moreover, a substantial increase in internal bond or Z-directional strength is realized. Therefore, the resulting product still has excellent tear strength, and surprising tensile and Z-directional strength.

EXAMPLE II

Five handsheets were made using a northern softwood kraft pulp beaten to a freeness of 250 ml. (TAPPI-T200). A polyvinyl alcohol powder was added to the pulp slurry such that the final product would contain 10% by weight of the polyvinyl alcohol. The emulsion of Example I was added in varying amounts to the pulp slurry of each one of the handsheets respectively. All of the sheets were dried on aluminum foil, and the tensile strength as well as tear strength for each one of the sheets was measured. The measured physical properties are tabulated in Table 2 below.

TABLE 2

| Handsheet | PPM Emulsion* | Tensile, lb/inch | Tear, gf |
|---|---|---|---|
| A | 0 | 161 | 1002 |
| B | 1 | 154 | 984 |
| C | 5 | 149 | 979 |
| D | 22 | 162 | 915 |
| E | 42 | 146 | 932 |

*ppm of organic constituents (lecithin + fatty acid or fatty acid and derivative)

From the foregoing Table, it can be seen that the presence of the emulsion does not have much of an effect on the physical properties of the final paper product. It was found, however, that the handsheets made with a slurry having only 0 and 1 ppm of the emulsion were very difficult to separate from the aluminum foil during the drying procedure. A handsheet made containing 5 ppm of the emulsion in the slurry could be peeled from the aluminum foil with no delamination or picking of the paper product. The handsheet made with 22 ppm of the emulsion separated easily, while the handsheet made with 42 ppm of the emulsion in the slurry fell off the aluminum foil. Thus, while the presence of the emulsion comprised of lecithin/fatty acid and/or derivative thereof does not significantly hurt the physical properties of the paper based product, its presence does permit one to easily manufacture, even on a continuous basis, products containing large amounts of a binder, such as polyvinyl alcohol.

EXAMPLE III

Three different furnishes comprised of a northern softwood kraft pulp and 10% by weight of a polyvinyl alcohol powder were made. The polyvinyl alcohol powder was of the grade Airvol 165SF manufactured by Air Products. The powder was allowed to swell overnight in cold water prior to addition to the furnish. To the first furnish no emulsion was added, while 20 ppm of the emulsion described in Example I was added to the second furnish. The third furnish received 40 ppm of the emulsion described in Example I.

All three furnishes were made into handsheets and were dried on an aluminum foil surface. The handsheet made from the first furnish which contained no lubricant stuck to the foil. The handsheet made from the second furnish containing 20 ppm of the emulsion of the present invention peeled off of the foil easily. The third handsheet made from the furnish containing 40 ppm of the emulsion released easily from the aluminum foil surface.

This Example demonstrates the beneficial results of the process of the claimed invention employing an emulsion of lecithin/fatty acid or derivative thereof when amounts of binder such as 10% by weight are used in the preparation of a paper based product. The advantages of the present invention are even more significant when higher amounts of binder are employed.

EXAMPLE IV

Five different types of handsheets were made containing northern softwood kraft woodpulp and varying amounts of synthetic fiber. These handsheets were dried in the laboratory on a Teflon-coated steam-heated drum. Three of the handsheets also contained varying amounts of polyvinyl alcohol binder, with the polyvinyl alcohol having been manufactured by Air Products under the designation Airvol 165SF. The peel strength of each handsheet was measured. The results are shown in Table 3 below.

TABLE 3

| Pulp (%) | Synthetic Fiber (%) | PVOH (%) | Peel Strength(g) Max | Peel Strength(g) Average |
|---|---|---|---|---|
| 100 | 0 | 0 | 225 | 172 |
| 90 | 10 | 0 | 283 | 206 |
| 74 | 9 | 17 | 724 | 373 |
| 69 | 9 | 22 | 848 | 573 |
| 60 | 8 | 32 | 1040 | 575 |

While it was not necessary to use the release emulsion, due to the drying on a Teflon surface, this example does show how the peel strength increases as the amount of polyvinyl alcohol increases. Use of the emulsion would permit one to realize the advantages of using increased amounts of polyvinyl alcohol in paper based products, particularly paper based products made on commercial papermaking equipment where the product roll is continuous and dried on drying cans or cylinders.

EXAMPLE V

Handsheets of a paper comprised of northern softwood kraft woodpulp and 10% 0.5 inch long 12 denier polyester fiber were made. 20% by weight of a binder material was added to the furnish of the handsheets to evaluate the effect of binder particle size. Among the binders examined were a polyvinyl alcohol powder which was fractionated by screening, an acrylic powder which was fractionated by screening, and a SBR latex. The polyvinyl alcohol powder was allowed to swell in cold water overnight prior to the addition to the furnish. The following Table presents the dry size and the swollen particle sizes of each binder.

TABLE 4

| Binder Type | Screen Mesh | Dry Size (microns) | Swollen Size (microns) | Equivalent Wood Fiber Diameters |
|---|---|---|---|---|
| SBR | None | 0.4 | 0.4 | 0.01 |
| Acrylic | T170 | 88 | 88 | 2.2 |
| PVOH | T170 | 88 | 176 | 4.4 |
| PVOH | 100–120 | 135 | 270 | 6.8 |
| PVOH | 60–80 | 220 | 440 | 11 |

The resulting handsheets were dried on a teflon coated, steam heated drying cylinder and then tested for strip tensile in the x-y plane. It was observed that the tensile strength increased as the size of the particle decreased. A plot of the particle size versus the average tensile can be found in FIG. 1. It should be noted that after about four equivalent fiber diameters, the tensile strength starts to fall off. The SBR latex reinforced sheet was not tested for tensile.

Figure 2:
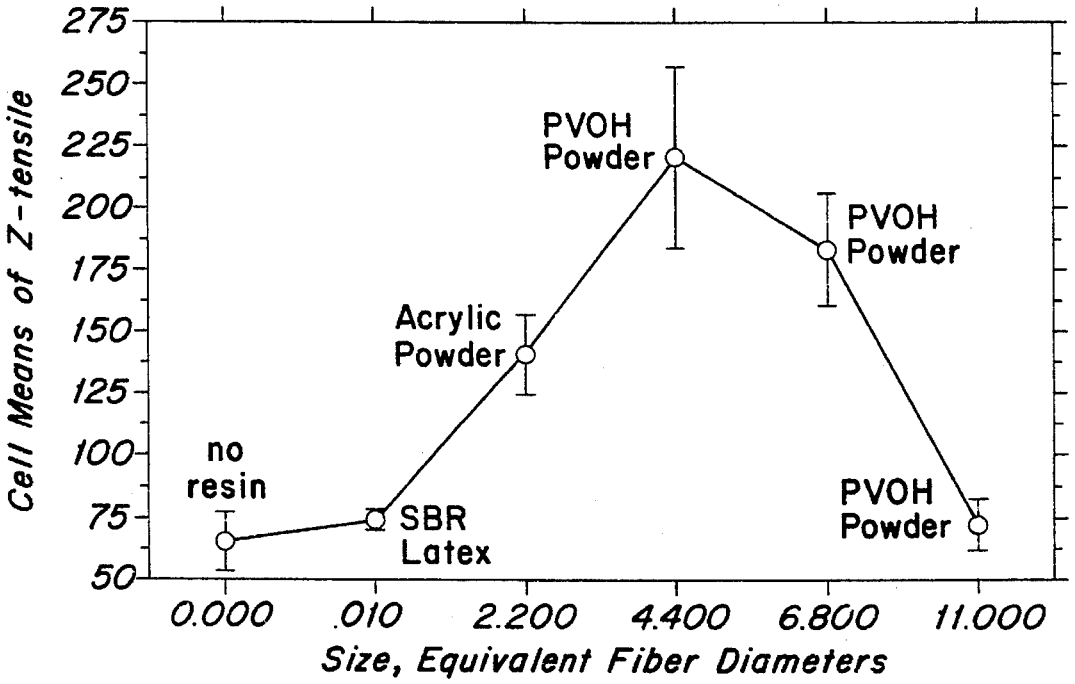
FIG. 2 is a plot of particle size versus Z-direction tensile strength relating to handsheets prepared containing a particulate binder.

Z-direction tensile strength was then measured for each handsheet. The data is plotted in FIG. 2 of the drawing. Note that the Z-direction tensile increases as the particle size is increased up to about four equivalent fiber diameters the Z-direction tensile strength begins to significantly decrease after about seven equivalent fiber diameters.

The data suggests that the most advantageous results can be obtained when the particles of the binder are in the size range of from about three to about seven equivalent cellulosic fiber diameters, and preferably around four equivalent cellulosic fiber diameters.

EXAMPLE VI

Lecithin available from Central Soya under the trademark CENTROPHASE HR2B was mixed with oleic acid in a 20:80 weight blend. Sufficient water was then added to the mixture to create a 2% by weight aqueous mixture, which was then sheared in a blender for about 2 minutes to create an emulsion containing 2% by weight organic ingredients (lecithin and fatty acid).

Handsheets of paper were made with a furnish containing 19% by weight polyvinyl alcohol powder (available from Air Products and Chemicals, Inc. under the trademark AIRVOL, grade 165SF) and 81% of a cellulosic pulp mixture. Sufficient emulsion was added to the water used in the handsheet mold to establish a concentration of the organic ingredients of 40 ppm. The wet sheet created was then lightly blotted and hand pressed onto the surface of the piece of aluminum foil. This foil was then placed on the surface of the dryer drum heated with 15 psig steam. A felt was placed on the other surface of the paper to keep it in contact with the foil.

After drying, the paper was removed from the aluminum foil. The amount of stickiness was evaluated and release was found to be quite satisfactory for any commercial utilization.

The procedure above was repeated to make 3 additional paper handsheets except that sufficient emulsion was used to establish a concentration of the organic constituents of 0, 25 and 75 ppm, respectively. The physical properties of the papers were also examined. The physical properties examined involved basis weight (lb/3000 sq.ft.), caliper (mils), permeability (Frazier), tensile strength (lb/in), tear strength (g) and burst strength (lb/sq.in.) The tensile strength was measured in accordance with TAPPI standard T404om-87, the tear strength in accordance with TAPPI standard T414om-82, and the burst strength in accordance with TAPPI standard T403om-91. The results of the tests are presented in the Table below.

TABLE

| ppm of Lecithin/ Oleic Acid Emulsion | BW (lb/3000 ssq. ft.) | Caliper (mils) | Perm (Frazier) | Tensile (lb/in) | Tear (g) | Burst (lb/sq. in.) | Stiff Gurley (mg) |
|---|---|---|---|---|---|---|---|
| 0 | 73 | 20 | 21 | 22 | 165 | 36 | 1480 |
| 25 | 73 | 22 | 28 | 20 | 162 | 32 | 1220 |
| 75 | 73 | 23 | 29 | 19 | 158 | 31 | 1190 |

The lecithin/oleic acid emulsion offers an excellent combination of properties. The lecithin mixes easily with the oleic acid, minimum foam is produced when the emulsion is made, the emulsion is stable and excellent release is obtained with little or no reduction in physical properties of the paper made. This underscores the advantages of the present invention.

While the invention has been described with preferred embodiments, it is to be understood that variations and modifications may be resorted to as will be apparent to those skilled in the art. Such variations and modifications ar to be considered within the purview and the scope of the claims appended hereto.

What is claimed is:

1. A process for making a paper based product which comprises (i) preparing a slurry comprised of a cellulosic pulp, a peel strength enhancing amount of a particulate binder sticky at the temperature of drying, and an emulsion comprised of lecithin and a $C_8$ to $C_{20}$ fatty acid or derivative thereof, with the amount of lecithin being sufficient to provide a stable emulsion with the fatty acid or derivative thereof;

(ii) draining the liquid from the slurry to form a web; and (iii) drying the web.

2. The process of claim 1, wherein the slurry is further comprised of synthetic fibers.

3. The process of claim 2, wherein the synthetic fibers comprise nylon, acrylic, rayon, aramid or polyester fibers.

4. The process of claim 2, wherein the synthetic fibers comprise polyester fibers.

5. The process of claim 2, wherein the amount of synthetic fibers comprises from 5 to 20 weight percent of the solids in the slurry.

6. The process of claim 1, wherein the binder contained in the slurry is polymeric and is polyvinyl alcohol powder, an acrylic powder, a phenolic powder or an epoxy powder.

7. The process of claim 6, wherein the binder in the slurry is a polyvinyl alcohol powder.

8. The process of claim 6, wherein the polymeric binder is present in the slurry in an amount of at least 10 weight percent based upon the solids in the slurry.

9. The process of claim 6, wherein the polymeric binder is present in the slurry in an amount of at least 15 weight percent based upon the solids in the slurry.

10. The process of claim 6, wherein the polymeric binder is present in the slurry in an amount of at least 20 weight percent based upon the weight of solids in the slurry.

11. The process of claim 6, wherein the polymeric binder is present in the slurry in an amount ranging from about 20 to about 30 weight percent based upon the weight of solids in the slurry.

12. The process of claim 7, wherein the polyvinyl alcohol binder is present in the slurry in an amount of at least 10 weight percent based upon the weight of solids in the slurry.

13. The process of claim 7, wherein the polyvinyl alcohol binder is present in the slurry in an amount of at least 20 weight percent based upon the weight of solids in the slurry.

14. The process of claim 7, wherein the polyvinyl alcohol is present in the slurry in an amount ranging from about 20 to about 30 weight percent based upon the weight of solids in the slurry.

15. The process of claim 1, wherein the water swollen size of the binder particulates added to the slurry is equivalent to from 3 to about 7 fiber diameters of the fibers contained in the product.

16. The process of claim 7, wherein the size of the polyvinyl alcohol particulates are equivalent to from 3 to about 7 fiber diameters of the fibers contained in the product.

17. The process of claim 1, wherein the weight ratio of lecithin to fatty acid or derivative thereof in the emulsion ranges from about 1:9 to about 3:7.

18. The process of claim 1, wherein the fatty acid or derivative thereof is comprised of a $C_{12}$ to $C_{18}$ fatty acid or derivative thereof.

19. The process of claim 1, wherein the additive package comprises a $C_8$–$C_{20}$ fatty acid ester.

20. The process of claim 1, wherein the fatty acid or derivative thereof is comprised of oleic acid.

21. The process of claim 17, wherein the amount of emulsion contained in the slurry is of an amount sufficient to provide a concentration of lecithin and fatty acid and/or derivative thereof in the range of from about 5 to about 40 ppm in the slurry.

22. The process of claim 21, wherein the amount of emulsion is sufficient to provide a concentration of lecithin and fatty acid and/or derivative thereof in the slurry from about 20 to about 40 ppm.

23. The process of claim 1, wherein the process is run on a fourdrinier machine on which a sheet is formed by draining an aqueous suspension through apertures on a continuously moving wire and then dried.

24. The process of claim 23, wherein the drying takes place on drying cans.

25. The paper based product prepared by the process of claim 1.

26. The paper based product prepared by the process of claim 2.

27. The paper based product prepared by the process of claim 6.

28. The paper based product prepared by the process of claim 9.

29. The paper based product prepared by the process of claim 10.

30. The paper based product prepared by the process of claim 12.

31. The paper based product prepared by the process of claim 13.

32. The paper based product prepared by the process of claim 17.

33. The paper based product prepared by the process of claim 23.

* * * * *